United States Patent [19]

Klefisch

[11] 4,290,753

[45] Sep. 22, 1981

[54] HEAT TREATING BASKET

[76] Inventor: Rudolf Klefisch, Siebengebirgsallee 165, D-5000 Kön 41, Fed. Rep. of Germany

[21] Appl. No.: 118,594

[22] Filed: Feb. 4, 1980

[30] Foreign Application Priority Data

Feb. 8, 1979 [DE] Fed. Rep. of Germany ..... 2904722

[51] Int. Cl.[3] ..... C21D 9/00; F27D 1/00

[52] U.S. Cl. ..... 432/261; 432/251

[58] Field of Search ..... 432/251, 253, 261, 258; 266/278

[56] References Cited

U.S. PATENT DOCUMENTS 1,862,540 6/1932 Koll ..... 432/253

2,461,606 2/1949 Jackson ..... 432/261

*Primary Examiner*—John J. Camby

*Attorney, Agent, or Firm*—Birch, Stewart, Kolasch & Birch

[57] ABSTRACT

A heat treating basket for receiving objects that are subjected to a heat treatment which comprises a bottom grating (10) the rim of which carries vertical struts (15) projecting in the upwardly direction. The upper ends of the struts are connected by a frame (16). In order to avoid breaks due to different thermal expansions of the bottom grating (10) and the frame (16) the horizontal struts (11,12) of the bottom grating (10) that are positioned in the vicinity of the corners of the heat treating basket are connected with the lower rim (14) of the bottom grating (10) by coupling members (21) which permit a lateral clearance.

9 Claims, 4 Drawing Figures

HEAT TREATING BASKET

The present invention relates to a heat treating basket comprising a bottom grating surrounded by a rim and having vertical struts projecting upwardly, and a frame connecting the upper ends of the struts.

Heat treating baskets for the transport of material to be heat treated in an annealing furnace and for quenching the hot material in the quenching bath are exposed to high fluctuations in temperature and to local differences in temperature so that they suffer from great heat stresses. When heat treating baskets filled with material are introduced into a furnace, the lower and upper edges are heated first while the bottom is first kept cold by the material to be heated. As a result of the different heating, the heat treating basket suffers from deformation and breaks.

In a known heat treating basket (German OS No. 22 05 579 ) the upper frame is interrupted at several points so that the upper frame and the edge of the lower grating may extend in different ways. However, the interruptions of the frame reduce the stability of the heat treating basket.

In another known embodiment of a heat treating basket, a grating-like bottom comprises longitudinal and transverse rods, the ends of which are interconnected by a surrounding rim and vertical struts carrying the frame are projecting from said rim. The upper frame is offset to the inside with respect to the lower rim in order to permit storing of several heat treating baskets. As a rule, the rods of the grating break off near the corners of the lower frame of such heat treating baskets and breaks are caused by thermal stresses. If the heat treating basket is introduced into a furnace, differences in temperature e.g. of 200° C. may cause changes in length of the rim of 3 mm while the grating within the rim is in the shadow of radiation. The grating is cooled by the material to be heated and it is kept cooler throughout the heating than the rim with the frame. In the subsequent quenching operation, by contrast, the frame and the rim are cooled down earlier than the grating.

To reduce the stresses caused by thermal conditions, an attempt has been made to interrupt the four corners at the upper frame and the lower rim of the heat treating basket. However, the risk of breakage is reduced to only a small extent by such interruptions. It is prohibitive to provide further interruptions at the composite heat treating basket because this would result in a loss of coherence and piling would probably become impossible.

It is the object of the present invention to design a heat treating basket of the type mentioned at the outset hereof in that in spite of the high differences in temperature during heating and cooling no destructive thermal stresses will occur and the stability of the heat treating basket as well as its coherence will be retained.

To achieve this objection, there is provided, according to the present invention, that at least some horizontal struts of the grating are connected with the rim by coupling members permitting a lateral clearance.

Due to the coupling members, the struts of the bottom grating may be displaced with respect to the unit of the lower rim and the vertical struts and no destructive material stress will occur. Thus, the upper frame and the lower rim may extend or contract independently from the struts of the bottom grating thus eliminating or at least reducing the risk of breakage.

It is not necessary to provide coupling members at all connecting points of struts of the bottom grating with the rim but they should be provided preferably only near the corners of the heat treating basket. In the central areas of the rim rods, the struts of the bottom grating may be connected integrally with or form one piece with the rim rods. Only with a certain distance from the rim rod center, coupling members providing a play, should be provided.

To realise the coupling members, preferably two lateral jaws each are mounted at the rim between which jaws the end of a bottom grating strut protrude. The jaws and the strut have aligned holes through which a rod is passed. The result is a hinge-like connection having a lateral clearance in order to connect a corresponding vertical strut with one of the bottom grating struts, with some clearance being provided. The coupling does not only permit a lateral play but also, to some extent, a turning of the two coupling elements relative to each other about the axis formed by the rod. The rod may be protected in the usual manner from its axial slide out of the coupling member. It is also possible to pass one sole rod through several coupling members aligned axially relative to each other.

In a favorable further embodiment of the present invention, the upper ends of the jaws are connected by a transverse element of an arcuate shape in longitudinal section. The strut protruding between the jaws has an upper round end. To limit the swivelling movement, the transverse member and the struts may be fitted with stops. The coupling by which the vertical struts are connected with horizontal struts has more or less a cross sectional shape of a saddle having bilateral liminations and abutment surfaces to limit the swivel movements about the rod axis.

To protect the rim from thermal material stresses it may consist of several rim rods which are loosely connected with each other. At the points of connection, one of the rim rods may be fitted with an eye for the passage of the other edge rod. The other rim rod is fitted with stops to limit its displaceability in the eye. The stability of the edge is only negligeably affected by such points of connection while, on the other hand, the play required for its extension is ensured.

It is readily possible to provide a mantle guard capable of being stored. To this effect, the upper frame is offset to the inside, with respect to the lower frame, and the ends of the bottom surfaces of the grating struts are retracted to form a support for the upper frame of a lower heat treating basket.

With reference to the Figs. a preferred embodiment of the present invention will be explained hereunder in detail:

Figure 1:
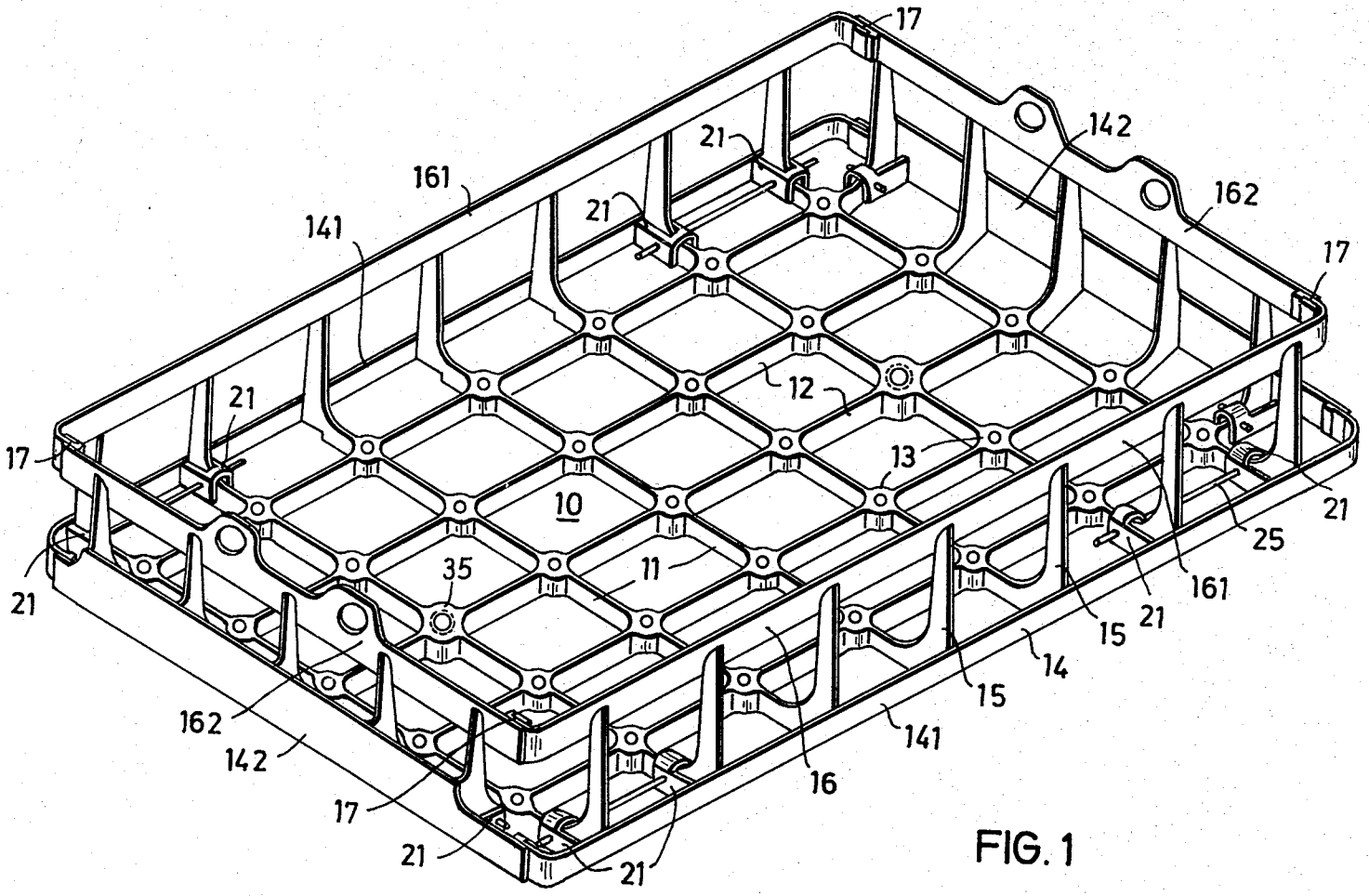
FIG. 1 is a perspective view of the mantle guard

The heat treating basket, FIG. 1, has a bottom grating 10 comprising longitudinal struts 12 and transverse struts 11. The longitudinal struts 12 and the transverse struts 11 form a grid net whose crossing points are designed as rings 13 for reasons of casting practice. The bottom grating 10 has a lower rim 14 consisting of a rod placed on edge. From the rim 14, vertical struts 15 project upwardly and their upper ends carry the frame 16 which also is formed by a rod disposed edgewise but offset to the inside with respect to the rim 14 in order to permit piling.

Figure 2:
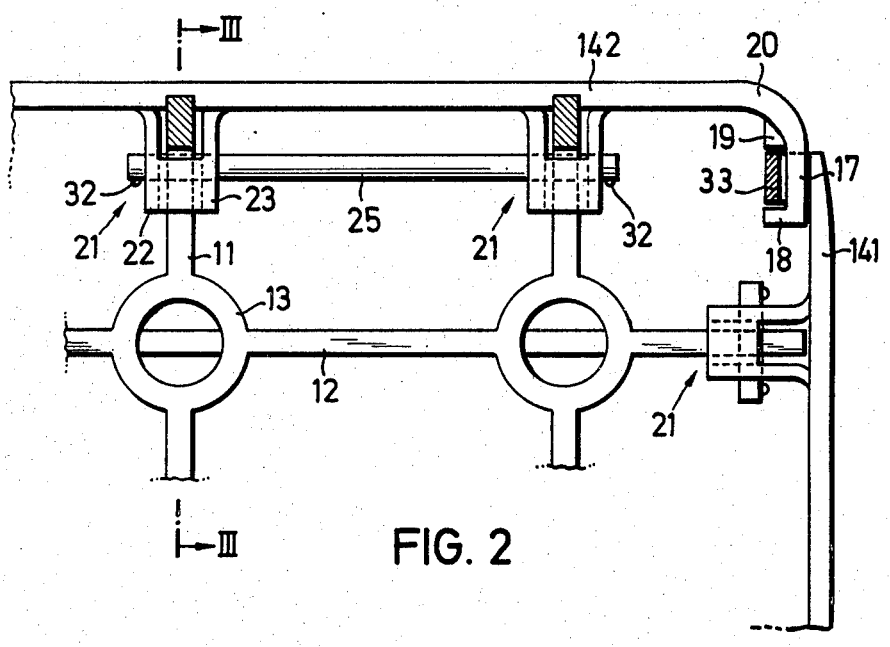
FIG. 2 is a scaled up top view of one corner of the heat treating basket

The rim 14 consists of several interconnected rods of which rods 141 extend in longitudinal direction, while rim rods 142 extend in transverse direction. As illustrated in FIG. 2, the rim rods 141 and 142 are connected with each other at the corner points. The rim rod 141 is provided with a welded eye 33 engaging the end 17 of the rim rod 142. Furthermore, the end 17 has a deflected extension 18 forming a shoulder abutting against the eye 33 and avoiding disconnecting of the assembly. Another extension 19 is provided at the end 17 opposite to the eye 33. The distance between the two stops 18 and 19 is somewhat greater than the width of the eye 33 so that the rim rods 141 and 142 can move towards each other with some play, but still they cannot be disengaged. As evident from FIG. 2, the eye 33 is within the area of the transverse side. The end 17 of the longitudinal rim rod 142 is protruding through a rectangular deflection 20 into the transverse side so that its direction is the same as that of the transverse rim rod 141.

The upper frame 16 also comprises two longitudinally extending frame rods 161 and two transversely extending frame rods 162. The connection between the frame rods 161 and 162 is just the same as that of frame rods 141 and 142.

As illustrated in FIG. 1, the transverse struts 11 and the longitudinal struts 12 near the corners of the grate are connected by coupling members 21 with the appertaining vertical struts 15 or with the rim 14 respectively. In the instant embodiment, with regard to the longitudinal rim rods 141, the two connecting points next to the corner are provided with such coupling members 21, while only one sole connecting point each which is next to the corner has such a compling element 21 in case of the transverse rim rods 142 which are shorter. The connecting points towards the center of the rim rods 142 and 142 are rigid, i.e. the vertical struts 15 form one piece with the transverse struts 11 or the longitudinal struts 12. All elements of the heat treating basket consist of a weldable cast steel alloy.

Figure 3:
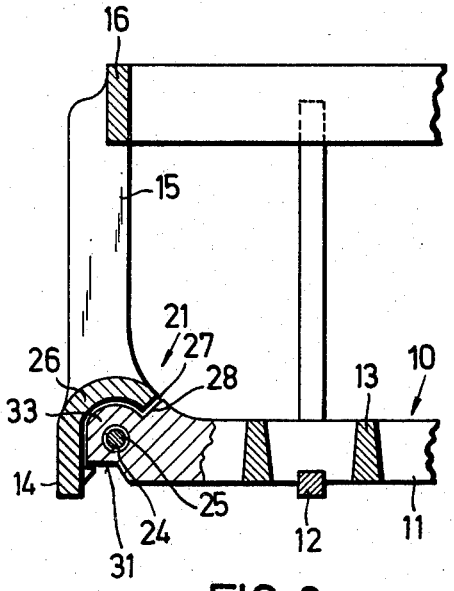
FIG. 3 is a section along line III—III of FIG. 2.

The construction of the coupling members 21 is evident from FIGS. 2 and 3. Each coupling member has two parallel jaws 22, 23 which project rectangularly from the rim 14 and are spaced from each other. The corresponding struts 11 or 12 of the grating pass through the jaws 22, 23. Through a hole 24 across the jaws 22 and 23 and the corresponding struts 11 or 12, a bar 25 is inserted to retain the corresponding strut between the jaws 22 and 23. The coupling member 21 gives so much clearance to struts 11 or 12 that the required displacement of the rim 14 relative to the bottom grating 10 is possible.

The jaws 22 and 23 are interconnected by a cross member 26 (FIG. 3). Its one end which faces the bottom grating 10 forms an abutment surface 27 for the abutment of a nose 28 of the strut 11 or as, so that the swivelling movement about the axis formed by the bar 25 is limited.

In vertical direction below the upper frame 16, the ends of the struts 11 or 12 are retracted at their bottom surfaces. The corresponding recesses 31 form a support for placing the heat treating basket on the upper frame 16 of another heat treating basket disposed underneath.

FIG. 2, shows welding points 32, provided at the projecting ends of bar 25 as check points. This arrangement prevents the bar 25, from being extracted in the longitudinal direction from the coupling members 21.

According to FIG. 3, it is evident that the longitudinal struts 12 of the grating 10 are more projecting in downward direction than the transverse struts 11. Thus, struts 12 may form skids to facilitate displacement of the heat treating basket on a base.

The transverse wall 26 has an arcuate longitudinal section—as obvious from FIG. 3—and the ends 33 of the struts 11 or 12 are round in the coupling members 21. Due to this shape a hinge connection movable within limits, can be formed.

Figure 4:
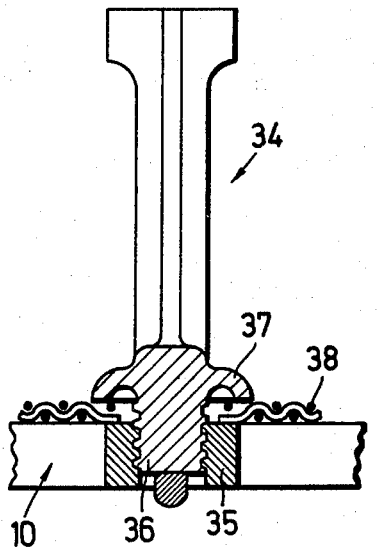
FIG. 4 is a partial section through a pillar for the support of stored heat treating baskets.

FIG. 4 shows the mounting of a pillar 34 at the bottom grating 10. One ring 35 of the bottom grating 10 has an internal thread for screwing the external thread at the lower end of the pillar 34. The pillar 34 projects in the vertical direction from the bottom grating 10 to support the bottom grating of another (non illustrated) heat treating basket piled above the heat treating basket in question.

Above the thread portion 36, the pillar 34 is provided with a surrounding collar directed downwardly. If a wire netting mat 38 on the bottom grating is provided with a hole for the passage of the pillar 34, the edge of the hole of the wire netting mat 30 is overengaged by the collar 37. If the pillar 34 is screwed up at the bottom grating 10, the edge of the hole of the wire netting mat 38 is compressed by the collar 37 so that no gap can be formed in which glowing material particles may adhere.

What is claimed is:

1. A heat treating basket for transporting material which is being heat treated which comprises a bottom grating containing elements thereof which extend into upwardly projecting struts which define the vertical walls of the basket;

an upper frame member connecting together the upper end portions of said struts;

a lower rim member for connecting together the lower portions of said struts, coupling members provided near the lower corners of said basket for loosely connecting the lower rim member to the bottom grating, and means for providing rigid connections between the lower rim member and the bottom grating, intermediate the coupling members.

2. The heat treating basket of claim 1 wherein the coupling member comprises two lateral jaws which extend from the lower rim member, said two lateral jaws defining an aperture therebetween, said upwardly projecting struts extending through said aperture, and means for securing said lateral jaws to said bottom grating.

3. The heat treating basket of claim 2 wherein the securing means include holes provided in the lateral jaws and the bottom grating and means for connecting said holes together.

4. The heat treating basket according to claim 1, wherein the upper ends of the jaws are connected together by a cross member having an arcuate longitudinal section and the strut protruding between the jaws has a round upper end portion.

5. The heat treating basket according to claim 4, characterized in that the cross member and the strut are provided with stop means for limiting the swivelling movement.

6. The heat treating basket according to claims 4, 5 wherein the lower rim is formed by several loosely connected rim rods.

7. The heat treating basket according to claim 6, wherein at the connecting points of the rim rods, one of the rim rods is provided with an eye through which the other rim rod extends and said other rim rod is provided with stops for limiting its displaceability in said eye.

8. The heat treating basket according to claims 1, 2, 3, 4 or 5 wherein the upper frame is offset to the inside with respect to the lower rim member and the bottom surfaces of the struts of the bottom grating are recessed at their ends to form a support for the upper frame member of a lower heat treating basket.

9. The heat treating basket according to claims 1, 2, 3, 4 or 5, wherein at least one pillar means is connected to the bottom grating, said pillar means being provided with a laterally projecting collar for compressing a wire netting mat against the bottom grating.

* * * * *